US009221662B2

(12) United States Patent
Bielmeier

(10) Patent No.: US 9,221,662 B2
(45) Date of Patent: Dec. 29, 2015

(54) FASTENING DEVICE FOR A CHANGEABLE ATTACHMENT AT A CONTAINER HANDLING STATION

(75) Inventor: Heinrich Bielmeier, Pilsting-Grosskollnbach (DE)

(73) Assignee: KRONES AG, Neutraubling (DE)

( * ) Notice: Subject to any disclaimer, the term of this patent is extended or adjusted under 35 U.S.C. 154(b) by 718 days.

(21) Appl. No.: 13/415,350

(22) Filed: Mar. 8, 2012

(65) Prior Publication Data

US 2012/0227225 A1 Sep. 13, 2012

(30) Foreign Application Priority Data

Mar. 10, 2011 (DE) ..... 10 2011 005 366

(51) Int. Cl.

*B25G 3/00* (2006.01)
*B67B 3/00* (2006.01)
*B67C 3/26* (2006.01)

(52) U.S. Cl.

CPC ..... *B67B 3/00* (2013.01); *B67B 2201/10* (2013.01); *B67C 2003/2668* (2013.01); *Y10T 24/45984* (2015.01); *Y10T 29/49815* (2015.01); *Y10T 29/49826* (2015.01); *Y10T 403/7005* (2015.01)

(58) Field of Classification Search

CPC ..... B67B 2201/10; B67C 2003/2668; F16L 37/242; F16L 37/252; Y10T 403/7005
USPC ..... 24/1, 457, 458, 700, 663; 285/81, 82, 285/376, 396, 401; 403/289, 290, 348, 349, 403/350, 353, 355, 356, 357
See application file for complete search history.

(56) References Cited

U.S. PATENT DOCUMENTS 4,028,771 A * 6/1977 Lin ..... 15/434
4,211,439 A * 7/1980 Moldestad ..... 285/27

(Continued)

FOREIGN PATENT DOCUMENTS

CN 1671972 A 9/2005
CN 101046268 A 10/2007

(Continued)

OTHER PUBLICATIONS

First Office Action, The State Intellectual Property Office of the People's Republic of China, Application No. 201210061700.2 dated Jan. 20, 2014. With Translations.

(Continued)

*Primary Examiner* — Gregory Binda
*Assistant Examiner* — Nahid Amiri
(74) *Attorney, Agent, or Firm* — Marshall, Gerstein & Borun LLP

(57) ABSTRACT

A fastening device for fastening a changeable attachment with a container handling station includes a first member and a second member formed as a fitting counterpart to said first member. The attachment can be transferred into the fastened position by uniting and rotating said members relative to each other. A fixed stop disposed on the fastening device in the fastened position prevents rotating the two members relative to each other in one rotational direction, and an elastic, radially snapable section acts as a stop without application of any external force and prevents the members from rotating relative to each other in the other rotational direction. The snapable section fastens the two members relative to each other and can be pressed in radially such that it no longer acts as a stop and the attachment can be rotated from the fastened position and removed from the container handling station.

19 Claims, 3 Drawing Sheets

(56) References Cited

U.S. PATENT DOCUMENTS

| | | | | |
|---|---|---|---|---|
| 4,842,439 | A * | 6/1989 | Caldwell et al. | 403/290 |
| 4,878,695 | A * | 11/1989 | Whitham | 285/39 |
| 6,447,027 | B1 * | 9/2002 | Lilley et al. | 285/360 |
| 7,845,685 | B2 * | 12/2010 | Blivet et al. | 285/314 |
| 7,959,192 | B2 * | 6/2011 | Elton et al. | 285/376 |
| 8,870,095 | B2 * | 10/2014 | Hughett et al. | 239/428.5 |
| 2002/0093192 | A1 * | 7/2002 | Matkovich | 285/3 |
| 2006/0284422 | A1 * | 12/2006 | Lunder | 285/401 |
| 2010/0218333 | A1 * | 9/2010 | Ritt | 15/250.201 |
| 2012/0000291 | A1 * | 1/2012 | Christoph et al. | 73/700 |

FOREIGN PATENT DOCUMENTS

| | | | | |
|---|---|---|---|---|
| DE | 872017 | C | 3/1953 | |
| DE | 20851 | | 2/1959 | |
| DE | 19755727 | C1 | 1/1999 | |
| EP | 379009 | A2 * | 7/1990 | B23B 31/02 |
| EP | 1245525 | A1 | 10/2002 | |
| EP | 1273551 | A1 | 1/2003 | |
| EP | 1772422 | A1 | 4/2007 | |
| EP | 1864941 | A1 | 12/2007 | |
| GB | 2332195 | A * | 6/1999 | B67B 3/00 |
| JP | 6227589 | A | 8/1994 | |
| WO | WO-2007/147463 | A1 | 12/2007 | |

OTHER PUBLICATIONS

Search Report for EP 12157731, dated Jun. 28, 2013.

Search Report for DE 102011005366.2, dated Jul. 28, 2011.

* cited by examiner

FASTENING DEVICE FOR A CHANGEABLE ATTACHMENT AT A CONTAINER HANDLING STATION

CROSS-REFERENCE TO RELATED APPLICATION

The present application claims the benefit of priority to German Patent Application 102011005366.2, filed Mar. 10, 2011, which is incorporated herein by reference in its entirety.

TECHNICAL FIELD

The disclosure relates to a fastening device for a changeable attachment at a container handling station, a container handling station with one or more of such fastening devices, and a method for changing such an attachment.

BACKGROUND

Attachments to machines for container handling are in the prior art often fixed in a threaded manner. If these attachments then need to be changed, then this leads to long change periods in which the entire container handling station is shut down. This can lead to significant costs, in particular where a change of the attachments needs to be performed frequently, as for example, different container or products are produced in a container handling station. In addition, threads are difficult to clean and therefore a potential source of germs when used in the food industry.

A quick-change device for a format head at a container handling station is known from patent specification DE 19755727, which fastens a format head in its position by a locking sleeve and allows for manual change without tools.

SUMMARY

In some arrangements, the disclosed fastening device, container handling station, and/or method may provide an improved fastening device for a changeable attachment at a container handling station. It also relates to a container handling station with one or several such fastening devices and to a method for changing such an attachment of a container handling station, which is attached with such a fastening device to the container handling station.

In various aspects of the invention, a fastening device for a changeable attachment at a container handling station according to claim 1, a container handling station according to claim 14, and a method according to claim 15 are provided. Advantageous embodiments of the invention are disclosed in the dependent claims.

Further aspects of possible embodiments will be apparent from the following figures.

DETAILED DESCRIPTION

Figure 1:
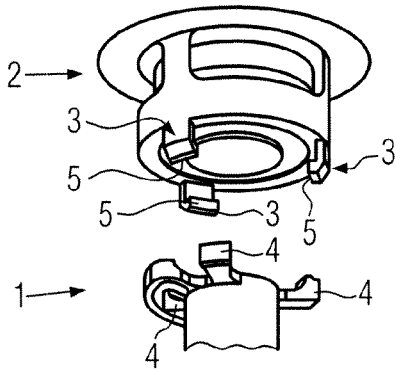
FIG. 1 shows an embodiment of a fastening device for fastening a changeable attachment.

The device according to some aspects of the disclosure comprises a first member having one, two, three, or more guides and a second member formed as a fitting counterpart to this member. The attachment is transformed into the attached position by uniting and rotating the two members relative to each other. The fastening device is formed such that a fixed stop is provided which in the fastened position prevents rotating the two members relative to each other in a rotational direction. In addition, the fastening device is provided with an elastic, radially snapable section which in the following is referred to as snap section. It is designed such that, in the fastened position, it acts as a stop without application of any external force preventing the members from rotating relative to each other in the other rotational direction, but can be pressed, for instance, from the outside inwards by pressure directed radially inwards. It then no longer acts as a stop and the attachment can be rotated from the attached position and separated from the container handling station.

The fastening device according to some aspects is designed such that uniting and separating the two members can also be performed manually without the use of further aids.

Due to the fact that the snap section responds to radial pressure, changing an attachment can be performed in a manner ergonomically advantageous, for instance, with only one hand having four fingers grasp the attachment and the thumb operate the snap section.

In a preferred embodiment, the portion of the snap section acting as a stop is disposed adjacent to a guide on the first member in such a manner, where the guide in turn is itself provided with a fixed stop, that the snap section in the attached position is disposed on the other side of the guide and the attachment is secured against rotation in two rotational directions, where this securing is based on the two stops adjacent to a guide.

In a further preferred embodiment, the attachment is a cone for a closer or a discharge tube for filling valves.

In further embodiments, the attachment comprises a cone for a closer, to which one or more elastic members are added which can compensate for size tolerances of closures. This allows for greater flexibility in the choice of closures to be processed.

Another preferred embodiment comprises that a rail running like a circular arc is formed on the side of each guide facing the second member. It can be formed as an elevation or a depression and when connecting the two members protrudes into the second member or into free sections in the second member or can serve as a receiving rail for a guide rail mounted to the second member. Arrangement of these rails can facilitate attachment of the member, as it can prevent any shifting of the two members relative to each other during rotation into the fastened position. The rails of a member are advantageously all located on an imaginary circle about an axis of the first member. It is also possible, however, that the circular arc-shaped rails are disposed on different imaginary circles about the axis of the first member. In this case, the second member must be formed accordingly and comprise a matching counterpart for each guide rail, where said counterparts additionally need to be disposed such that their sequence match the sequence of the guides of the first member, the members thus being able to be fastened in each other.

In one embodiment, the guides are formed integrally with the first member or made of material differing from the rest of the member. This can be advantageous depending on the material and the purpose: In the integrally formed case, cleaning of the member can be facilitated by the integral formation of the guides with the member, which can prevent accumulation of for instance impurities in the otherwise existing joining regions. In other cases, guides made of material that differs from the rest of the first member can be advantageous. For example, in the case that material otherwise used for the member is soft or little resistant to deformation, it can be advantageous when the guides are formed of harder and resistant material such as metal or durable plastic. In a fastening device according to the disclosure, rounding off the edges of the first member can be advantageous, which can make accumulation of impurities more difficult.

In a further embodiment, the snap section is formed as a bow. It can be made entirely or partly of suitable elastic material such as metal or plastic. A bow has the advantage that its application can be self-explanatory and it can be accessible from the outside and easily cleaned.

Another embodiment comprises, that on the (outer) surface of the snap section, an area is disposed which is coated with material having higher frictional resistance than the material from which the rest of the snap section is formed. Alternatively, in another embodiment, the area on the (outer) surface of the snap section can be formed of such material. Any slipping off when applying pressure on this area can thus be made more difficult. In this manner, exchanging the attachment is facilitated because the user does not slip off as easily as he pushes on the bow and can thereby much better separate the attachment from the container handling station.

Other embodiments comprise that the snap section is fastened on the first member by a portion protruding from the first member. This can have the advantage that the snap section has a smaller curvature and therefore the material is less stressed. The position of the snap section can also be precisely determined by a section protruding from the first member. Alternatively, the snap section can in some embodiments also be directly attached to the first member without any spacer.

In a preferred embodiment, one of the two members of the fastening device is mounted on the attachment or forms part of the attachment. The counterpart is fixedly connected to the container handling station. Fixedly can presently mean, that the counterpart forms a part not separable from the container handling station or is connected to it by an attachment form such as screws or welding points, which can usually only be again separated using special tools.

In further embodiments, a receiving means for each guide is each formed on the second member. This receiving means can comprise a limitation radially outward and a hook-shaped support, which can prevent movement along the axis of rotation away from the second member.

In preferred embodiments, these receiving means for the guide are formed such that one or two guides with their receiving means laterally abut in a flush manner. Free sections are preferably between the receiving means for guides, into which the guides, the fixed stop and the snap section can be inserted along the rotational axis. From this position, the two members can then be rotated against each other and be guided into the attached position.

In a further embodiment, the guides of the first member and the receiving means for the guides on the second member provided therefor are arranged equidistantly along a circle about the axis of the respective member. The weight of the attachment or the force exerted to it can be distributed evenly, which can thus result in increased stability of the arrangement. In this case, the various receiving means can be designed identically. This can enable a simplified connection of the two members, since not attention needs to be paid to which guide is to enter into which receiving means.

In a further preferred embodiment, the snap section is mounted on the first member such that, on the side on which it is attached to the member, it is located within the outer radius defined by the guide. At the guide, at which it acts as a stop, it protrudes beyond the outer radius defined by the guides. This is advantageous because when rotating into the attached position, the snap section automatically is pressed inward (e.g. by a receiving means for the guide). This facilitates uniting the two members since separate actuation of the snap section is not absolutely necessary for insertion, though possible. Once the members are in the predetermined fastened position, the snap section can snap out and thus act as a stop.

A disclosed container handling station is characterized in that it comprises one or more fastening devices for fastening a changeable attachment according to one of the embodiments described.

A method for manually changing the attachment, which is connected with a fastening device for fastening a changeable attachment according to one of the embodiments described, comprises applying pressure radially (inwardly) onto the snap section so that it no longer acts as a stop. It further comprises rotating the two members from the fastened position against each other in the direction of rotation which is enabled by operating the snap section, and separating the two members by removing the attachment from the container handling station. Subsequently, another attachment is installed which comprises the steps of uniting the members and rotating to the fastened position. Once the guides are in the receiving means, the snap section can also snap outwards and thus act as a stop. The attachment is thereby in the fastened position. Removing an attachment and fastening an attachment can also be performed in reverse order or at time intervals.

Turning now to the exemplary embodiments shown in the drawings, FIG. 1 shows a fastening device for fastening a changeable attachment. It comprises a first member 1 and a second member 2 which is formed as a counterpart to member 1. The second member 2 in the case referred to comprises three receiving means 3 for guides 4. These receiving means are formed such that, in the fastened position, they prevent any displacement of the first member in the radial direction. In addition, they also prevent separation of the members because they engage beneath the member and thus prevent shifting in a direction away from the second member by means of hook-like supports 5. As is evident from FIG. 1, the first member 1 can by uniting the members and subsequent rotation be transferred into the fastened position. Any pushing from below or the side is not possible due to the arrangement of the receiving means 3 because the receiving means 3 comprise a radial limitation and supports being hook-shaped below. The guides 4 are in this case disposed equidistantly along an imaginary circle. The receiving means 3 are in this example also similarly designed, they thus do not differ from each other, which facilitates uniting the members 1, 2, since no attention needs to be given to which guide enters into which receiving means. In other embodiments (presently not shown), however, individual guides 4 and receiving means 3 of a member 1, 2 can also be formed differently from one another, so that when uniting the two members, it needs to be given attention which guide gets into which receiving means.

Figure 2:
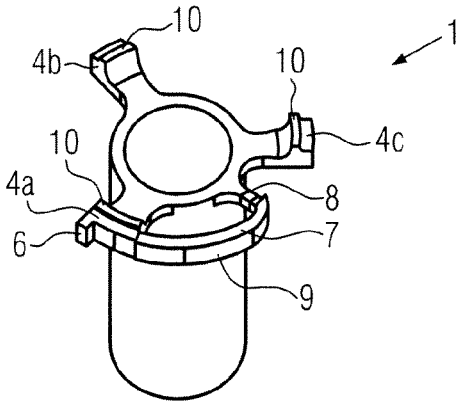
FIG. 2 shows a detailed view of the first member of an embodiment of a fastening device for fastening a changeable attachment at an angle from above.

FIG. 2 shows a detailed view of the first member from FIG. 1 at an angle from above. Here, three guides 4*a*, 4*b* and 4*c* can again be seen, while in this example, the guide 4*a* laterally comprises a fixed stop 6. This stop 6 is in this case formed integrally with the guide 4*a*. However, it can also be formed from another material. On the other side of the guide 4*a*, a snap region 7 is visible. It is in this example formed as a bow which is attached on the first member 1 to a portion 8 protruding from the first member 1. In this example, it comprises an optional area 9 on the outer surface which is coated with a material or formed of a material having higher frictional resistance than the material from which the rest of the snap region is formed, so that when applying pressure, one is less likely to slip off. A fastening device according to the disclosure for fastening a changeable attachment at a container handling station can additionally have circular arc-shaped rails 10 attached on the guide, which serve to provide additional stabilization of the two members which can be useful when rotating into the fastened position. The described rails engage in a free section 11 of member 2 (see FIG. 3) in this example.

Figure 3:
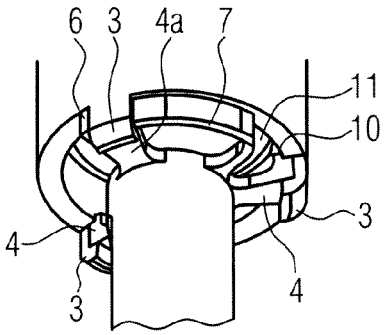
FIG. 3 shows an embodiment of a fastening device for fastening a changeable attachment in a fastened position.

FIG. 3 shows an embodiment of a fastening device for fastening a changeable attachment at a container handling station in a fastened position; Here one can see that the receiving means 3 are in this case arranged not only equidistantly on a circle, but also flush with the guides 4. The fixed stop of guide 4*a* stabilizes the two members against rotating relative to each other in a rotational direction, while the snap element 7 in the attached position shown here acts as a stop on the other side of guide 4*a* and thus prevents rotation of the members against each other in the other rotational direction. As long as the snap member 7 is in this position, the two members 1, 2 are in the fastened position. It is additionally visible in FIG. 3, that the optional circular arc-shaped rail 10, which in the present case is formed as an elevation but can also be formed as a depression (not shown), in the present case engages in the free section 11 of the second member 2 and can thus additionally prevent slipping of the two members 1, 2 relative to each other.

Figure 4:
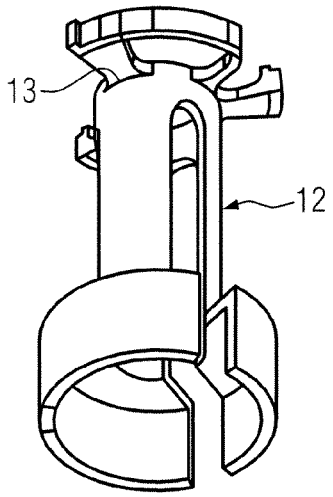
FIG. 4 shows a further embodiment of the fastening device for fastening a changeable attachment.

FIG. 4 shows an embodiment, in which the attachment comprises a cone for a closer, to which one or more elastic members 12 are added which can compensate for size tolerances of closures. It can be seen in this embodiment, that a first member can comprise angular edges 13 at the point of application of the guide. In some embodiments, a rounded shape of these edges may be advantageous in order to make accumulation of material in the edges more difficult.

Figure 5A:
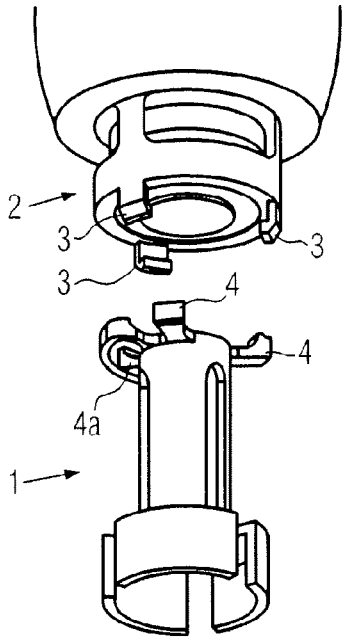
FIGS. 5*a*-5*c* show a sequence of inserting a changeable attachment into a an container handling station with a fastening device for fastening a changeable attachment according to the disclosure.
Figure 5B:
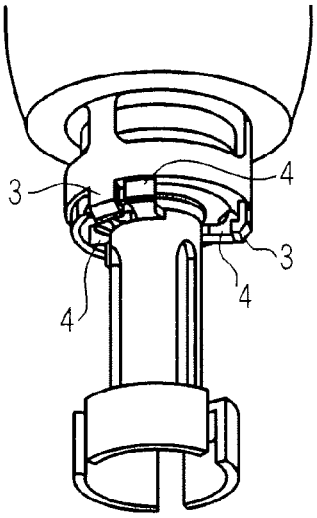
Figure 5C:
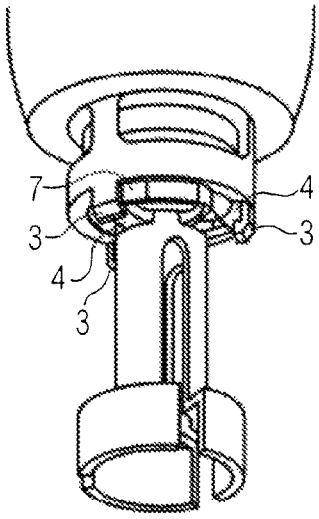

FIG. 5, including FIGS. 5*a*-5*c*, shows steps of the process of fastening an attachment according to the disclosure, where the attachment in this example comprises a closer.

FIG. 5*a* shows the two members 1, 2 still in a separated position.

FIG. 5*b* shows how members 1, 2 are united. The guides 4 are guided from below into the free sections adjacent to the receiving means 3. These free sections adjacent to the receiving means 3 must be large enough so that the guides 4 and also the guides 4*a* with the fixed stop 6 and the snap section 7 can be directed and mounted straight onto the second member 2. Then the two members 1, 2 are rotated against each other in a manner that the guides 4 enter into the receiving means 3. Coating of parts of the guides 4 or the entire guides 4 and/or parts of the areas or the entire area of the second member 2 contacting the guides 4, for example with Teflon, can in some embodiments reduce friction force between the two members 1, 2 (not shown here). When rotating from position 5*b* to position of 5*c*, the snap area 7 is pressed inwardly by the receiving means, thus opening the path for the rotation, without the snap section needing separate actuation such as with a finger. As soon as the guides 4 have reached the receiving means 3, the rotation is terminated automatically by the fixed stop 6. In this position, the snap section 7 can also snap outwardly. Since the snap section 7 now acts as a stop, the fastening device is now in the fastened position.

The fastened position is shown in FIG. 5*c*. Removal of the attachment is performed analogously in reverse sequence (not shown here): By applying radial pressure (such as with the thumb) onto the snap section 7, it is pressed inwardly and no longer acts as a stop. In this manner, the two members 1, 2 can be rotated against each other from the fastened position in a direction until the guides 4 and the fixed stop 6 and the snap element 7 rest in the free sections adjacent to the receiving means 3. Subsequently, the two members 1, 2 can then be separated.

Numerous modifications to the fastening device, container handling station, and/or method disclosed herein will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

The invention claimed is:

1. A fastening device in combination with a changeable attachment for a container handling station comprising:

a first member;

and a second member; and said changeable attachment mounted to one of the first member and the second member;

the first member having one or more guides;

the second member formed as a fitting counterpart to said first member, wherein said attachment can be transferred into a fastened position by uniting and rotating said first and second members relative to each other in a first rotational direction;

and wherein the first member further comprises:

a fixed stop which in the fastened position engages a first portion of the second member and thereby prevents rotating said first and second members relative to each other in the first rotational direction; and a snap section comprising an elastic, radially snapable section, wherein the snap section forms a radially shiftable stop, which in the fastened position engages a second portion of the second member and without application of any external force prevents said first and second members from rotating relative to each other in a second rotational direction opposite the first rotational direction and fastens said first and second members relative to each other, and wherein said snap section serving as said radially shiftable stop is arranged to be shifted radially by radially directed force such that the snap section no longer engages the second portion of the second member in a manner to prevent said first and second members from rotating relative to each other in the second rotational direction and thereby said attachment can be rotated from the fastened position and removed from said container handling station when coupled to the respective first and second members.

2. The fastening device and changeable attachment according to claim 1, wherein the portion of said snap section acting as the radially shiftable stop is disposed adjacent to a first one of the guides, and said first guide is provided with the fixed stop, such that in the attached position, the fixed stop and the radially shiftable stop are disposed on opposite sides of said first guide and said attachment is thus secured against rotating in said first and second rotational directions relative to said second member by said fixed stop on said guide and said radially shiftable stop.

3. The fastening device and changeable attachment according to claim 1, wherein said attachment comprises a cone for a closer or a discharge tube for filling valves.

4. The fastening device and changeable attachment according to claim 1, wherein said attachment comprises a cone for a closer to which one or more elastic members are added which can compensate for size tolerances of the closure.

5. The fastening device and changeable attachment according to claim 1, wherein on a side of said guides of said first member facing said second member, a rail in the form of a circular arc is formed which is formed as an elevation or a depression and when connecting said first and second members protrudes into said second member or into free sections in said second member or into which a guide rail of said second member can be inserted.

6. The fastening device and changeable attachment according to claim 1, wherein said guides are integrally formed with said first member.

7. The fastening device and changeable attachment according to claim 1, wherein said snap section is formed as a bow which is made entirely or partly of elastic material.

8. The fastening device and changeable attachment according to claim 1, wherein on a surface of said snap section, an area is disposed comprising a material having higher frictional resistance than material from which the rest of said snap section is formed whereby slipping off when applying pressure on the area is made more difficult.

9. The fastening device and changeable attachment according to claim 1, wherein said snap section is fastened on said first member by a portion protruding from said first member.

10. The fastening device and changeable attachment according to claim 1, wherein one of the first and second members is fastened to said attachment for a container handling station or is formed as part of said attachment and the other of the first and second members is to be fixedly connected to said container handling station.

11. The fastening device and changeable attachment according to claim 1, wherein a receiving means for each guide is formed in the second member.

12. The fastening device and changeable attachment according to claim 11, wherein said receiving means for one or two guides laterally connects flush with said guide.

13. The fastening device and changeable attachment according to claim 11, wherein said guides of said first member and said receiving means of said second member are disposed equidistantly along a circle.

14. The fastening device and changeable attachment according to claim 13, wherein said receiving means for one or two guides laterally connects flush with said guide.

15. The fastening device and changeable attachment according to claim 1, wherein said snap section is mounted on said first member such that, on a side on which the snap section is attached to said first member, the snap section is located within an outer radius defined by said guides, and on a first one of said guides on which the snap section acts as the radially shiftable stop, the snap section protrudes beyond said outer radius defined by said guides.

16. A container handling station comprising one or more fastening devices and the changeable attachment according to claim 1.

17. The fastening device and changeable attachment according to claim 1, wherein said guides on said first member are made of a material differing from the rest of said first member.

18. The fastening device and changeable attachment according to claim 1, wherein said snap section is formed directly connected to said first member.

19. A fastening device for fastening a changeable attachment at a container handling station comprising:

a first member, the first member having one or more guides;

and a second member, the second member formed as a fitting counterpart to the first member and having receiving means that receive the one or more guides to releasably fasten the first member with the second member, wherein the first member is transferred into a fastened position relative to the second member by uniting and rotating the first and second members relative to each other in a first rotational direction such that the guides are received by the receiving means;

and wherein the first member further comprises:

a fixed stop which in the fastened position engages a first portion of the second member and thereby prevents rotating the first and second members relative to each other in the first rotational direction; and an elastic, radially snapable section, which forms a radially shiftable stop, wherein the radially shiftable stop in the fastened position without application of any external force engages a second portion of the second member and prevents the first and second members from rotating relative to each other in a second rotational direction opposite the first rotational direction, and wherein the radially shiftable stop is arranged to be pressed radially inwardly by radially directed force such that the radially shiftable stop no longer engages the second portion of the second member in a manner that prevents said first and second members from rotating relative to each other in the second rotational direction and thereby said first member can be rotated from the fastened position and removed from said second member.

* * * * *